United States Patent [19]

Hatch

[11] 4,345,813

[45] Aug. 24, 1982

[54] KEYABLE CONNECTOR-HEADER ASSEMBLIES FOR MULTIPLE CONDUCTOR CABLES

[75] Inventor: David A. Hatch, Sherborn, Mass.

[73] Assignee: Pintek, Inc., Newton Upper Falls, Mass.

[21] Appl. No.: 133,426

[22] Filed: Mar. 24, 1980

[51] Int. Cl.[3] ..... H01R 23/64

[52] U.S. Cl. ..... 339/184 M

[58] Field of Search ..... 339/184 R, 184 M, 186 R, 339/186 M

[56] References Cited

U.S. PATENT DOCUMENTS 3,573,711 4/1971 Henschen ..... 339/184 M X

FOREIGN PATENT DOCUMENTS 2807017 8/1979 Fed. Rep. of Germany ... 339/184 M

*Primary Examiner*—Eugene F. Desmond

[57] ABSTRACT

An electrical connection system including a plug-in connector housing for receiving a plurality of electrical signal wires, a plurality of connector contacts retained by the housing, a header body for receiving the connector housing, a plurality of header contacts retained by the body and each positioned so as to engage one of the connector contacts upon reception of the connector housing by the header body, connector keying means selectively disposed at any of a plurality of predetermined positions on the housing, and header keying means selectively disposed at any of a plurality of given positions on the header body and each corresponding to one of the predetermined positions on the connector housing. The individual components are shaped and arranged such that engagement between the connector contacts and the header contacts is prevented by engagement between the connector keying means and header keying means when disposed at any corresponding pair of the predetermined and given positions.

16 Claims, 12 Drawing Figures

KEYABLE CONNECTOR-HEADER ASSEMBLIES FOR MULTIPLE CONDUCTOR CABLES

BACKGROUND OF THE INVENTION

This invention relates generally to a system for mass termination of multiple signal wires and, more particularly, to keyable connector and header assemblies for that purpose.

Cables composed of multiple signal wires are used extensively in many electronic applications. Particularly popular are both flat and twisted flat ribbon cables that alternate ground wires with signal wires to reduce interwire cross talk. Typically, the conductive wires in these cables are mass terminated in connector units that plug into mated header units on a circuit board. Often systems utilize many pairs of identical connector-header assemblies mounted in closely spaced relationship to each other. Consequently, care must be exercised to prevent engagement between disassociated pairs of assemblies. Such engagement would produce misconnection of signal wires and result in a circuit dysfunction.

The technique currently employed to prevent mismatching of header and connector assemblies entails the modification of the contacts utilized therein. For example, plugging a female contact in a given position on a particular connector will prevent its entry into any header having a male pin contact in a corresponding position. However, engagement with an associated header can be accommodated after removal therefrom of a male pin contact in the corresponding position. By appropriately selecting unique patterns of such contact plugging and pin removal, individual pairs of connectors and headers can be keyed for exclusive mating. Although eliminating problems of misconnection, the contact modification method exhibits the disadvantage of sacrificing contacts that could otherwise be dedicated to signal wires. In addition, contact modifications are not highly visible which sometimes leads to damage during inadvertent attempts to force engagement between mismatched assemblies.

The object of this invention, therefore, is to provide an improved connection system in which each of a plurality of individual connector units can be uniquely keyed for mating with only one of a plurality of individual header units.

SUMMARY OF THE INVENTION

The invention is an electrical connection system including a plug-in connector housing for receiving a plurality of electrical signal wires, a plurality of connector contacts retained by the housing, a header body for receiving the connector housing, a plurality of header contacts retained by the body and each positioned so as to engage one of the connector contacts upon reception of the connector housing by the header body, connector keying means selectively disposed at any of a plurality of predetermined positions on the housing, and header keying means selectively disposed at any of a plurality of given positions on the header body and each corresponding to one of the predetermined positions on the connector housing. The individual components are shaped and arranged such that engagement between the connector contacts and the header contacts is prevented by engagement between the connector keying means and header keying means when disposed at any corresponding pair of the predetermined and given positions.

By selectively disposing the connector keying means and header keying means in unique patterns on a plurality of plug-in connectors and header bodies, individual pairs thereof can be uniquely mated so as to prevent inadvertent connection between disassociated pairs of connectors and headers.

In a preferred embodiment of the invention, the connector housing defines at each of the predetermined positions a connector receptacle and the header body defines at each of the given positions a header receptacle, the connector keying means comprises a plurality of distinct keying elements each insertable in one of the connector receptacles, and the header keying means comprises a plurality of distinct header keying elements each insertable into one of the header receptacles. The distinct connector and header keying elements facilitate the keying of connectors and headers and are highly visible so as to discourage attempts to force engagement between mismatched units.

One feature of the invention is the provision of connector keying elements that are detachably securable and comprise resilient portions that are distorted during entry into the connector receptacles, and the header keying elements also are detachably securable and comprise resilient portions that are distorted during entry into the header receptacles. The resilient keying elements are easily secured to the connectors and headers during a selective keying process and if desired can be removed later and repositioned to establish a modified keying combination.

According to another feature of the invention, each connector housing comprises at least four distinct predetermined positions and each header body comprises at least four distinct given positions. The use of at least four distinct positions substantially increases the number of unique keying combinations available in a given connection system.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
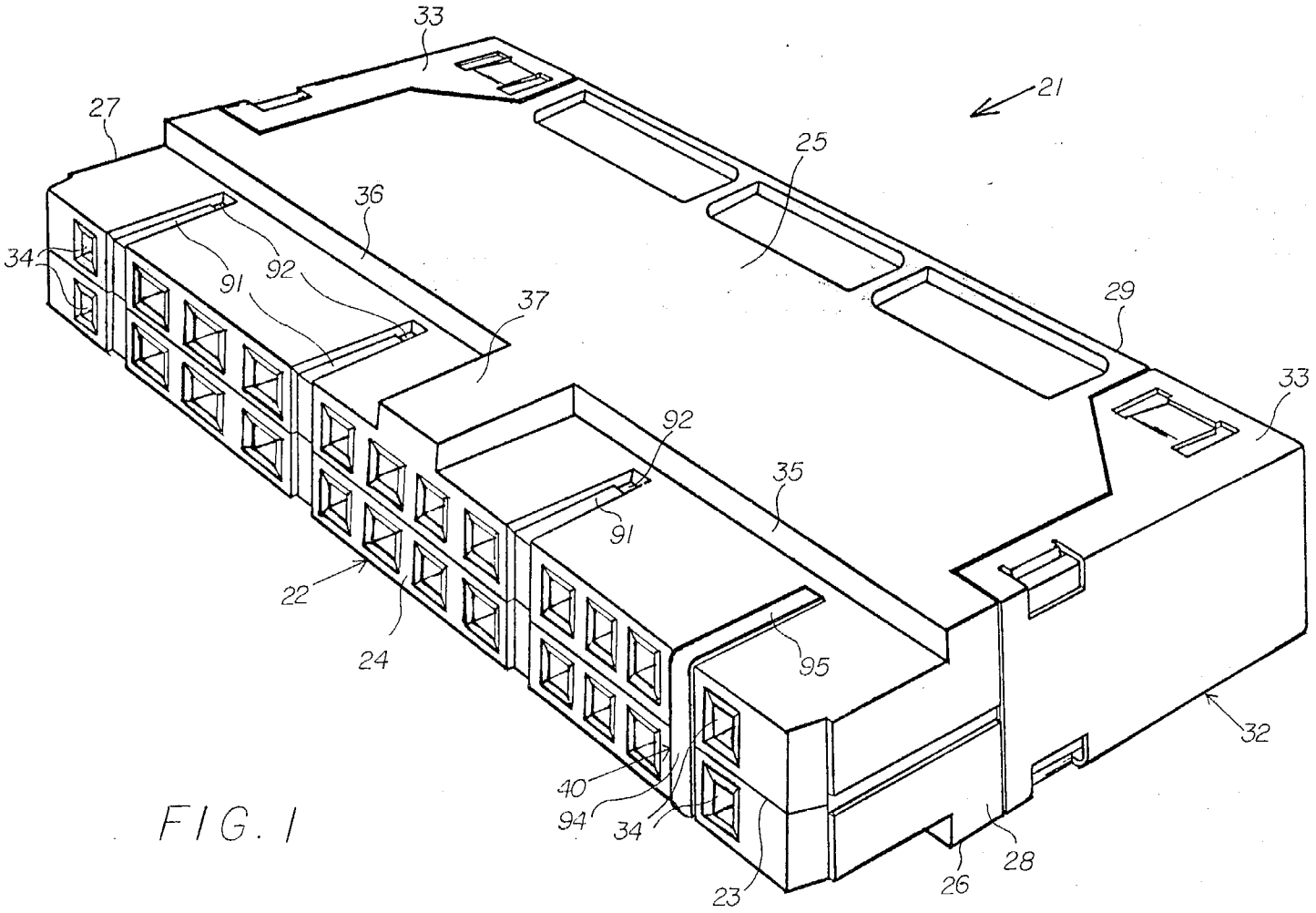
FIG. 1 is a schematic isometric view of an electrical connector constructed according to the invention.

Referring to FIG. 1, there is shown a connector 21 for terminating multiple-wire flat ribbon cables. The connector 21 includes a connector housing 22 formed by the pair of mated body halves joined together along a joint 23. Forming the outer surfaces of the connector housing 22 are a face or front surface 24, a top surface 25, a bottom surface 26, side walls 27 and 28, and a rear surface 29 adapted to permit entry of a flat ribbon cable. Each of the surfaces 24–29 is substantially rectangular so as to provide the connector housing 22 with an overall rectangular form. Retained by each of the side walls 27 and 28 is a connector ground contact 32. Terminal appendages 33 on opposite ends of the ground contacts 32 overlie and are fixed, respectively, to portions of the top and bottom surfaces 25 and 26. Defined by the front surface 24 are a plurality of uniformly spaced apart cavities 34 positioned to receive pin connectors of a mating header assembly shown in FIG. 2. Rotational alignment with that header assembly is ensured by a pair of spaced apart recesses 35, 36 that form a ridge portion 37. A connector keying element 40 is detachably secured to the housing 22 and is hereinafter described in detail.

Figure 2:
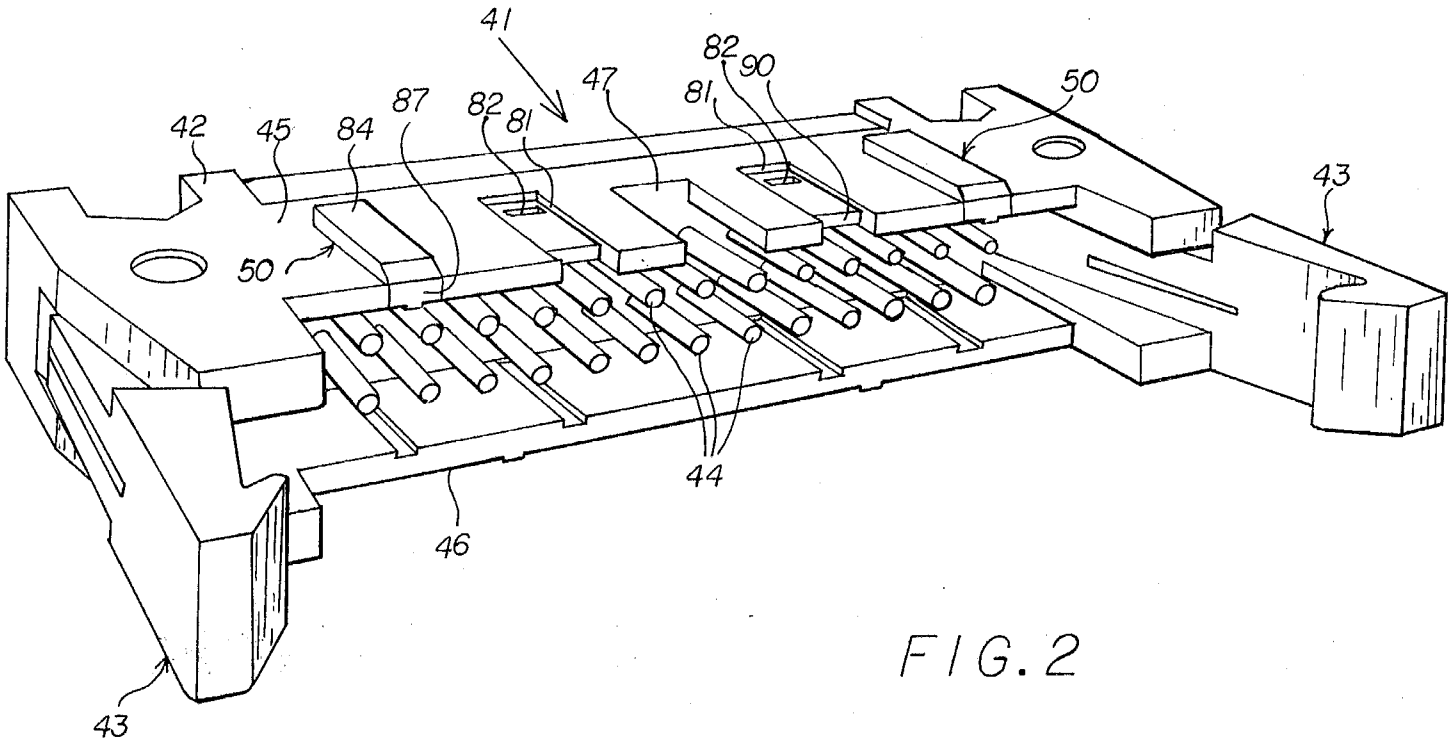
FIG. 2 is a schematic isometric view of a header assembly for use with the connector shown in FIG. 1.

Referring now to FIG. 2, there is shown a header assembly 41 formed by a header body portion 42 and latching mechanism 43 at opposite sides thereof. Retained by the body portion 42 is an array of header pin contacts 44. The header body 42 has an upper wall 45 and a spaced therefrom lower wall 46 that straddle the connector pins 44. The upper wall 45 defines a centrally located alignment slot 47 that receives the ridge 37 (FIG. 1) upon proper insertion of the connector housing 22 into the header body 42. The ridge 37 and the slot 47 prevent insertion of the connector housing 22 into the header body in the event of rotational misalignment therebetween. This feature prevents, for example, insertion of the connector housing 22 after an inadvertent 180-degree rotation thereof with respect to the header assembly 41. Detachably secured to the header body 42 and described in detail hereinafter is a header keying element 50.

Figure 4:
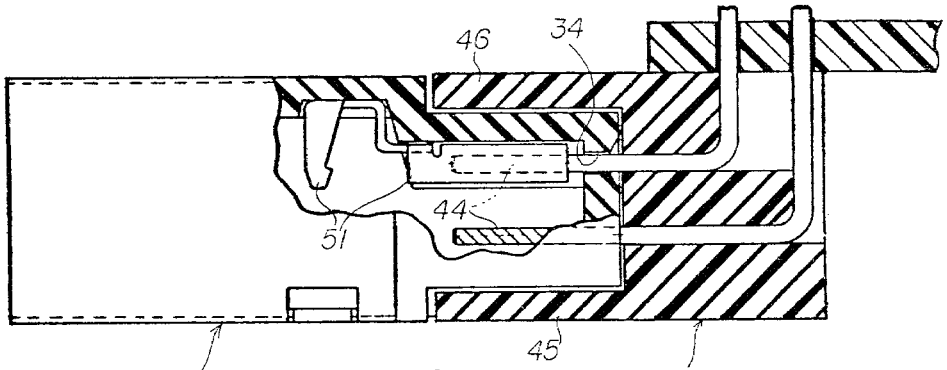
FIG. 4 is a partial schematic cross-sectional view taken along the lines 4—4 in FIG. 3.
Figure 3:
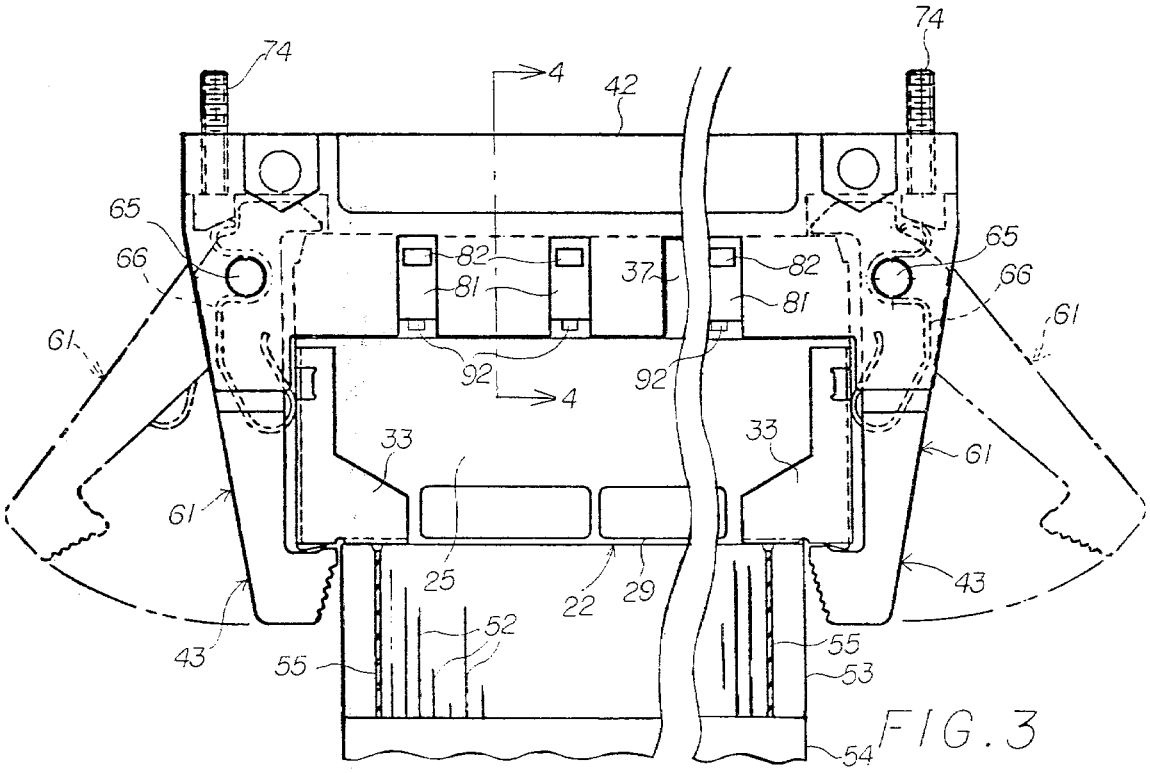
FIG. 3 is a schematic top view of the connector shown in FIG. 1 connected to the header shown in FIG. 2.

Referring now to FIGS. 3–6, there is shown a connector system in which a connector housing 22 has been plugged into a header body 42. In the arrangement illustrated, however, the keying elements 40 and 50 have been detached from, respectively, the connector housing 22 and the header body 42. After proper mating of a connector and header assembly, each of the header pin contacts 44 extends into one of the cavities 34 in the front surface 24 of the connector housing 22 and engages a connector contact 51 retained therein as shown in FIG. 4. Each of the connector contacts 51 within the connector housing 22 is connected to a different signal wire 52 of a flat ribbon cable 53 that enters an opening in the rear surface 29 of the connector housing 22. Although only a single connector contact 51 is shown in FIG. 4, it will be understood that the connector housing 22 retains a large number of the contacts 51, each of which connects a different one of the signal wires 52 to a different one of the header pin contacts 44. The specific details of those connections are not a part of this invention per se, but a description of suitable connector contacts and their use appears in U.S. Pat. No. 4,095,862. As depicted in FIG. 3, the cable 53 is equipped with an electrically conductive sheet 54 that overlies and shields the individual signal wires 52 from electrical interference. A pair of drain wires 35 connect the cover shield 54 to the ground contacts 32.

Figure 5:
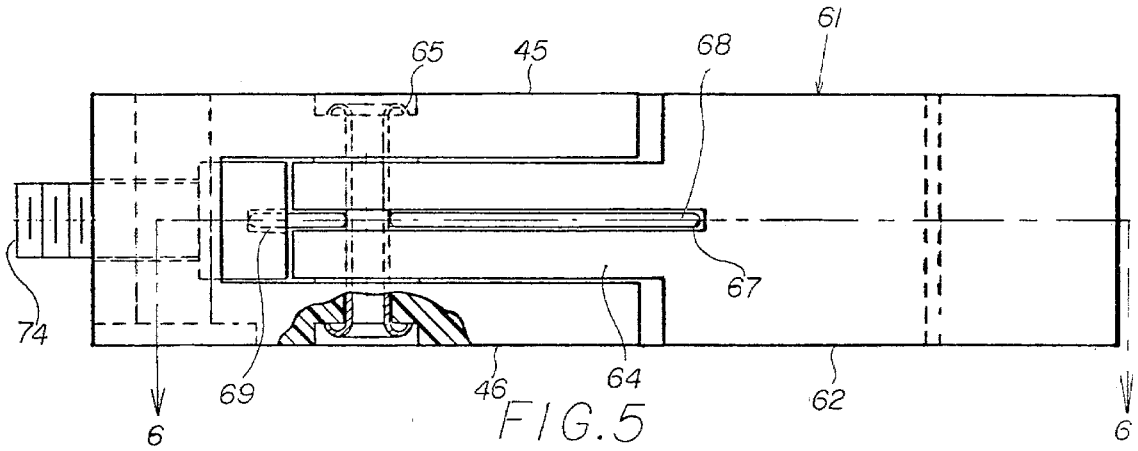
FIG. 5 is a side view of the mated connector and header arrangement shown in FIG. 3.
Figure 6:
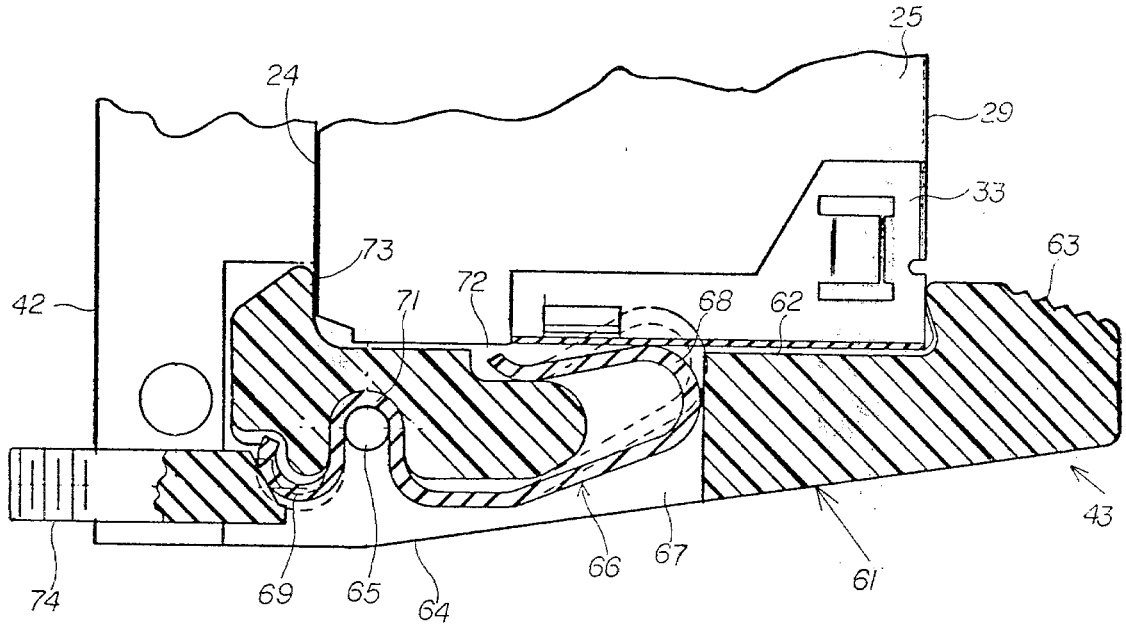
FIG. 6 is a partial schematic cross-sectional view taken along the lines 6—6 in FIG. 5.

Referring now to FIGS. 5 and 6, there is shown in greater detail one of the latch mechanisms 43 illustrated in FIGS. 2 and 3. Although only one of the latch mechanisms 43 is shown in detail, it will be understood that the two are identical. The latching mechanism 43 includes a latching arm 61 having an elongated central portion 62 straddled by a hook portion 63 and a base portion 64. Pivotally securing the base portion 64 between the upper and lower walls 45, 46 of the header body 42 is a pivot pin 65. A bridge contact 66 is retained in a recess 67 that extends between the central portion 62 and the base portion 64. Forming the bridge contact 66 is a convoluted spring member having at its opposite ends first and second U-shaped spring portions 68 and 69. The first and second spring portions 68 and 69 are joined by a U-shaped mounting portion 71 that receives the pivot pin 65 so as to retain the contact 66 within the recess 67. Defined in the inner surface of the central portion 62 is an opening 72 into the recess 67 and through which extends the first resilient spring portion 68.

Prior to entry of the connector housing 22 into the header body 42, the latching arms 61 are in open positions shown by dotted lines in FIG. 3. However, as the connector 22 enters the header body 42, the front connector surface 24 engages shoulder portions 73 extending from the base portions 64 of the latching arms 61. Further movement of the connector 22 into the header body 42 causes rotation of the latching arms 61 around the pivot pins 65 into the latched positions shown by solid lines in FIGS. 3 and 6. In those positions, the elongated central portions 62 of the latched arms 61 lie directly adjacent to the side walls 27 and 28 and the hook portions 63 of the latch arms 61 engage the rear connector surface 29 to firmly retain the connector housing 22 in place. Also, the first spring portions 68 of the bridge contacts 66 are in contact with the connector ground contacts 32 and the second spring portions 69 thereof are in contact with fixed contact studs 74 retained by the header body 42. Thus, the shield 54 on the cable 53 is electrically connected by the bridge contacts 66 to the contact studs 74 which are in turn connectable to chassis ground. During this latching operation, the first and second portions 68 and 69 of the bridge contact 66 move from their normal positions shown by dotted lines in FIG. 6 into their engaged positions shown by solid lines therein. This movement between their normal and engaged positions induces the first spring portions 68 to make sliding or wiping contacts with the connector ground contacts 32 and the second spring portions 69 to make similar wiping contacts with the contact studs 74. Because of the wiping engagement provided, oxidation is removed from the contact surfaces and a good electrical connection is established with each latching operation. When disconnection is desired, the arms 61 are pivoted outwardly about the pivot pins 65 causing the shoulder portions 73 to eject the connector 22 from the header 42.

Figure 9:
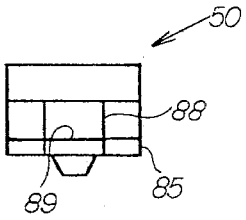
FIG. 9 is a schematic end view of the keying element shown in FIGS. 7 and 8.
Figure 7:
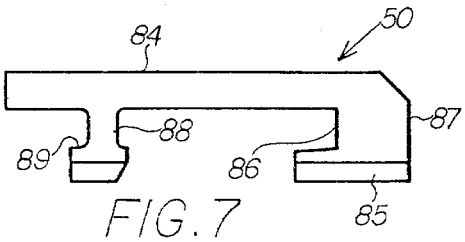
FIG. 7 is a schematic side view of a keying element used with the header of FIG. 2.
Figure 8:
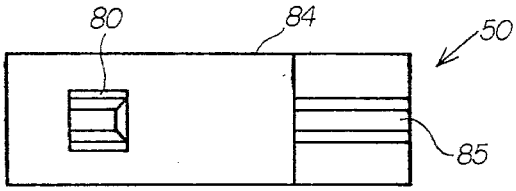
FIG. 8 is a schematic bottom view of the keying element shown in FIG. 7.
Figure 10:
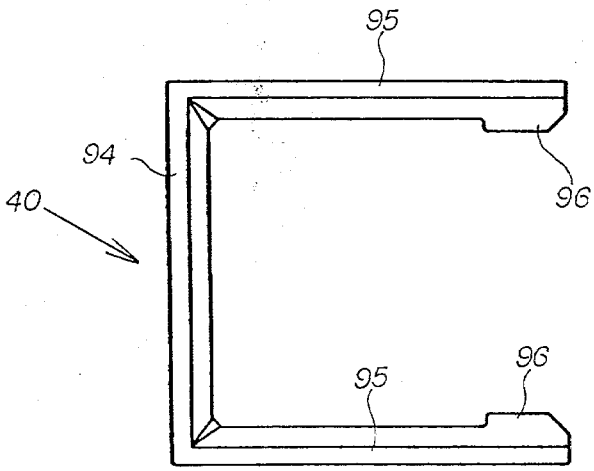
FIG. 10 is a schematic side view of a keying element used with the connector shown in FIG. 1.
Figure 11:
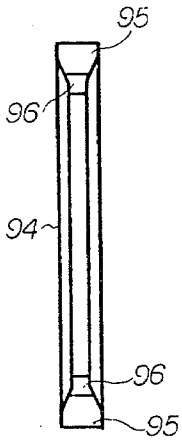
FIG. 11 is a schematic end view of the keying element shown in FIG. 10.

Referring again to FIG. 2, a plurality of spaced apart recesses 81 define given positions in the upper wall 45 of the header body 42. Associated with each of the positions 81 is a header receptacle 82 formed by an opening in the upper wall 45. Detachably secured to the header body 42 at one of the given positions 91 is the header keying element 50. As shown more clearly in FIGS. 7–9, the header keying element 50, preferably formed from a resilient plastic such as Du Pont's DELRIN plastic, comprises an elongated distortable trunk portion 84. Extending transversely from one end of the trunk portion 84 is a base that defines an inwardly directed slot 86 and an outwardly directed abutment surface 87. A tab portion 88 extends transversely from the trunk portion 84 near its opposite end and forms a shoulder 89. When a header keying element 50 is mounted on the header body 42, the trunk portion 84 is accommodated by a recess 81, the slot portion 86 receives the edge of a wall portion 90 defining the bottom of the recess 81 and the tab 88 is received by the corresponding opening 82 in the upper wall 45. The dimensions of the header keying element 50 are such that after engagement of the recessed wall portion 90 by the slot portion 86, the trunk portion 84 must be distorted to permit passage of the shoulder 89 through the opening 82. Once thus inserted, the shoulder 89 engages the bottom surface of the upper wall 45 to securely hold the header keying element 50 in the selected position 81. However, by exerting an upward pressure on the tab 88 to again distort the trunk portion 84, the header keying element 50 can be removed from the header body 42.

Figure 12:
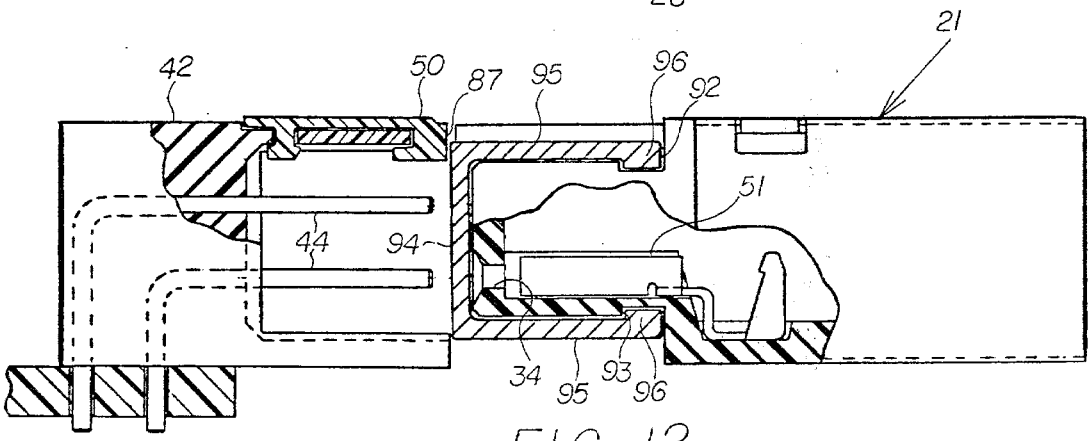
FIG. 12 is a schematic cross-sectional view similar to that shown in FIG. 4 but with the keying elements in place.

Referring again to FIG. 1, aligned grooves in the front, top and bottom surfaces 24–26 form a plurality of U-shaped grooves 91 spaced apart at particular positions on the connector housing 22. As shown in FIG. 3, each of the particular positions 91 corresponds to and is aligned with one of the given positions 81 on the header body 42. Each of the grooves 91 is terminated by an opening 92 in the top surface 25 and an opening 93 in the bottom surface 26 (FIG. 12). Detachably secured in one of the groove positions 91 is a connector keying element 40 having the form of a U-shaped clip and fabricated from a suitable spring material such as Beryluim copper. The clip 40 comprises a yoke portion 94 straddled by resilient leg portions 95. An inwardly directed tab 96 terminates each of the leg portions 95. When positioned on the connector housing 22, the yoke portion 94 overlies the front surface 24 and the tabs 96 are received by the openings 92 and 93 in, respectively, the top surface 25 and the bottom surface 26. The dimensions of the connector keying element 40 are such that upon being positioned in a particular groove 91, the tabs 96 forcibly engage the bottom surfaces thereof causing outward distortion of the leg portions 95. However, upon reaching the openings 92 and 93, the tabs 96 are forced thereinto by the resilient leg portions 95 to lock the clip element 40 in place. Subsequent removal of a keying element 40 requires separation of the leg portions 95 to remove the tabs 96 from the openings 92 and 93.

A plurality of the header keying elements 40 and the connector keying elements 50 are used to uniquely mate together given pairs of the connectors 21 and headers 41 in a connection system involving a plurality of those units. In this way, the inadvertent connection of a connector 21 into an unassociated header assembly 41 is prevented. Unique mating is established by appropriate distribution of the header keying elements 40 and the connector keying elements 50 in positions that result in engagement therebetween which in turn prevents connection between the contacts in unmated pairs of connectors and headers. Such engagement will occur between any connector keying element 40 located in one particular position 91 on a connector housing 22 and a header keying element 50 located in a corresponding given position 81 on a header body 42. For example, with the header keying element 50 in the given position 81 shown in FIG. 2 and the connector keying element 40 in the corresponding particular position 91 shown in FIG. 1, the connector housing 22 cannot be inserted completely into the header body 42 so as to produce contact between the header contacts 44 and the connector contacts 51. As illustrated in FIG. 12, complete insertion of the connector housing into the header body 42 is prevented by engagement between the yoke portion 94 of the connector keying element 40 and the abutment surface 87 of the header keying element 50.

In a properly keyed multiple unit system, none of the connector keying elements 40 will occupy in any connector any particular position 91 that corresponds to a given position 81 on a mated header in which a header keying element 50 is present. Conversely, all unmated header and connector combinations will possess at least one pair of interfering connector and header keying elements 40 and 50 that occupy corresponding key positions. In this regard, it is preferred that the connectors 21 and headers 41 be provided, respectively, with at least four particular positions 91 and four given positions 81 so as to make available a number of unique keying combinations that is a substantial multiple of the distinct key positions provided. For example, in the illustrated system involving four distinct key positions on each of the header and connector assemblies, 10 different unique keying combinations are possible.

Figure 13:
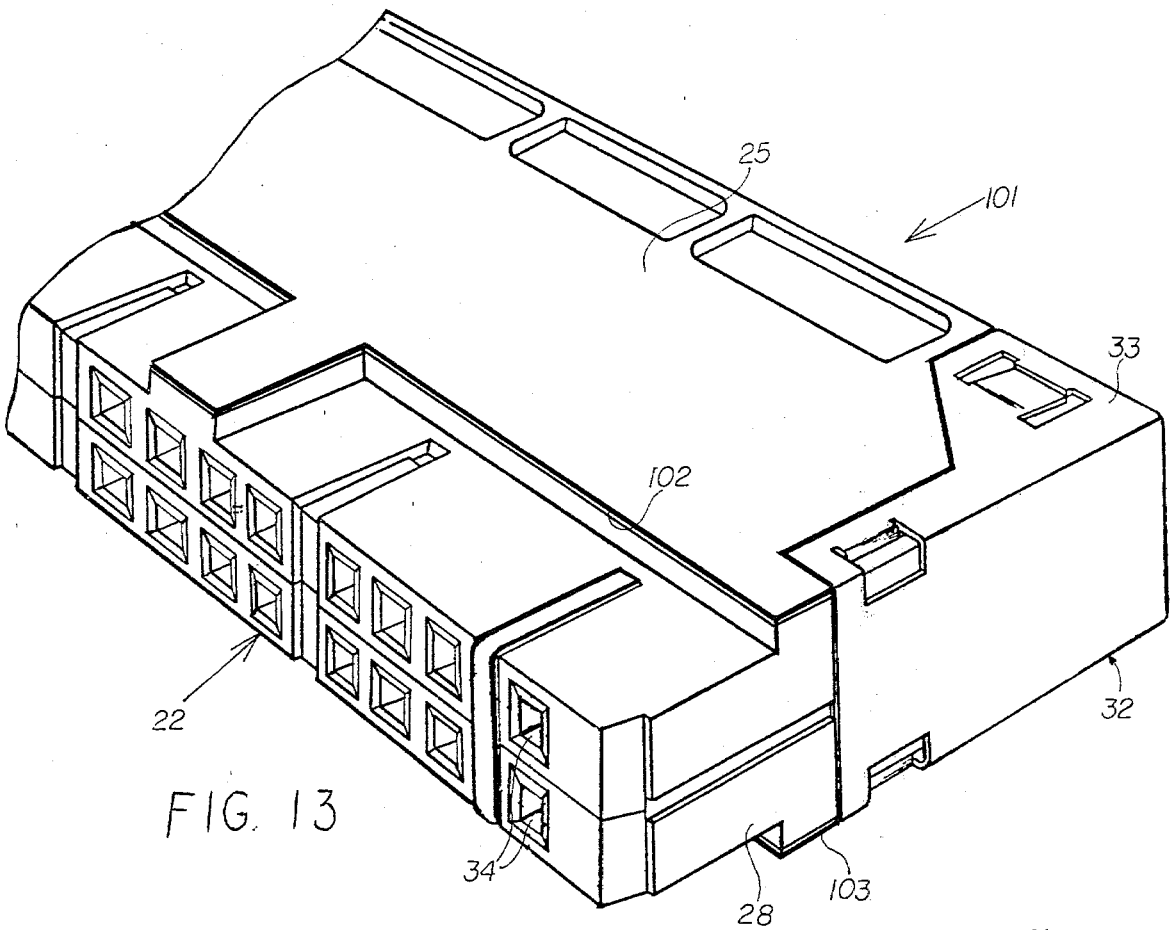
FIG. 13 is a schematic isometric view of another connector embodiment of the invention.

Referring now to FIG. 13, there is shown a connector embodiment 101 that is identical to the connector 21 of FIG. 1 except for the use of additional connector ground contact portions 102 and 103 with the ground contacts 32. Segments of the connector 101 that are identical to those of the connector 21 bear the same reference numerals. The ground contact portions 102 and 103 consist of coatings, formed with a suitable electrically conductive material, that substantially cover, respectively, the top and bottom surfaces 25 and 26 of the housing 22. During use of the connector 101 with the header unit 41 shown in FIG. 2, the ground contacts 32 function as described above to automatically connect a cable shield to chassis ground. In addition, however, the conductive coating ground portions 102 and 103 together with the contacts 32 function as a ground potential shield for the signal wires within the connector 101. Thus, the embodiment 101 provides additional protection against electrical interference with signals carried by the assembly.

Obviously, many modifications and variations of the present invention are possible in light of the above teachings. It is to be understood, therefore, that the invention can be practiced otherwise than as specifically described.

What is claimed is:

1. An electrical connection system comprising:

a plug-in connector housing adapted to receive a plurality of electrical signal wires;

a plurality of connector contacts retained by said housing and each shaped and arranged for connection to one of the signal wires;

a header body shaped and arranged to receive said connector housing;

a plurality of header contacts retained by said body and each positioned so as to engage one of said connector contacts upon reception of said connector housing by said header body;

connector keying means selectively disposed at any of a plurality of predetermined positions on said housing; and header keying means selectively disposed at any of a plurality of given positions on said header body and each corresponding to one of said predetermined positions on said connector housing, and wherein when disposed at any corresponding pair of said predetermined and given positions said connector keying means and said header keying means are shaped and arranged to engage and prevent engagement between said connector contacts and said header contacts.

2. A system according to claim 1 wherein said connector keying means comprise distinct connector keying elements each securable to said housing at any of said predetermined positions, and said header keying means comprise distinct header keying elements each securable to said header body at any of said given positions.

3. A system according to claim 2 wherein said housing defines at each of said predetermined positions a connector receptacle for one of said connector keying elements, and said header body defines at each of said given positions a header receptacle for one of said header keying elements.

4. A system according to claim 3 wherein said connector keying elements are detachably securable and comprise resilient portions that are distorted during entry into said connector receptacles, and said header keying elements are detachably securable and comprise resilient portions that are distorted during entry into said header receptacles.

5. A system according to claim 4 wherein said header contacts comprise an array of pins; said connector housing comprises a face portion that defines an array of cavities and extends between substantially parallel top and bottom surfaces, and each of said cavities is disposed to receive one of said pins upon reception of said connector housing by said header body.

6. A system according to claim 5 wherein said connector receptacles comprise openings in said top and bottom surfaces, each of said connector elements comprises a U-shaped clip having resilient leg portions terminating with inwardly directed tabs, and each of said clips can be moved selectively over said face portion into any of said predetermined positions wherein one of said tabs enters one of said openings in said top surface and the other of said tabs enters a corresponding opening in said bottom surface.

7. A system according to claim 1 wherein said predetermined and given positions each comprises at least four distinct positions.

8. A system according to claim 7 wherein said connector keying means comprise distinct connector keying elements each securable to said housing at any of said predetermined positions, and said header keying means comprise distinct header keying elements each securable to said header body at any of said given positions.

9. A system according to claim 8 wherein said housing defines at each of said predetermined positions a connector receptacle for one of said connector keying elements, and said header body defines at each of said given positions a header receptacle for one of said header keying elements.

10. A system according to claim 9 wherein said connector keying elements are detachably securable and comprise resilient portions that are distorted during entry into said connector receptacles, and said header keying elements are detachably securable and comprise resilient portions that are distorted during entry into said header receptacles.

11. A system according to claim 10 wherein said header contacts comprise an array of pins; said connector housing comprises a face portion that defines an array of cavities and extends between substantially parallel top and bottom surfaces, and each of said cavities is disposed to receive one of said pins upon reception of said connector housing by said header body.

12. A system according to claim 11 wherein said connector receptacles comprise openings in said top and bottom surfaces, each of said connector elements comprises a U-shaped clip having resilient leg portions terminating with inwardly directed tabs, and each of said clips can be moved selectively over said face portion into any of said predetermined positions wherein one of said tabs enters one of said openings in said top surface and the other of said tabs enters a corresponding opening in said bottom surface.

13. A system according to claim 1 wherein said header body receives said connector housing in response to a given sense of relative movement therebetween, and including rotational alignment means preventing said header body from receiving said connector housing in the absence therebetween of a predetermined relative rotational orientation with respect to said given sense of relative movement.

14. A system according to claim 13 wherein said alignment means comprise alignment portions of said header body and connector housing that engage to prevent said given sense of movement therebetween in the absence of said predetermined relative rotational orientation.

15. A system according to claim 14 wherein said connector keying means comprise distinct connector keying elements each securable to said housing at any of said predetermined positions, and said header keying means comprise distinct header keying elements each securable to said header body at any of said given positions.

16. A system according to claim 15 wherein said housing defines at each of said predetermined positions a connector receptacle for one of said connector keying elements, and said header body defines at each of said given positions a header receptacle for one of said header keying elements.

* * * * *